United States Patent [19]

Govang et al.

[11] Patent Number: 4,877,137

[45] Date of Patent: Oct. 31, 1989

[54] DISPLAY PACKAGE MODULE FOR PROMOTIONAL DISPLAY USE

[75] Inventors: James A. Govang, Killingworth; Mark E. Goldstein, Farmington, both of Conn.

[73] Assignee: The Stanley Works, New Britain, Conn.

[21] Appl. No.: 21,986

[22] Filed: Mar. 5, 1987

[51] Int. Cl.[4] ..... B65D 19/38

[52] U.S. Cl. ..... 206/597; 108/53.1; 108/55.1; 108/56.1; 206/45.14; 206/45.31; 206/497; 206/586

[58] Field of Search ..... 108/53.1, 53.3, 53.5, 108/55.1, 55.5, 56.1, 51.1; 206/386, 547, 600, 45.31, 45.33, 45.19, 497, 486, 459, 45.14, 45.11, 586, 562, 563; 229/23 R; 53/443, 447

[56] References Cited

U.S. PATENT DOCUMENTS

| | | | |
|---|---|---|---|
| 2,534,010 | 12/1950 | Frye | 229/23 R |
| 2,665,806 | 1/1959 | Budd | 229/23 R |
| 3,008,572 | 11/1961 | Wagner | 206/600 |
| 3,049,265 | 8/1962 | Van Moss et al. | 220/97 |
| 3,137,388 | 6/1964 | Strouth . | |
| 3,231,084 | 1/1966 | Kean, Sr. | 206/597 |
| 3,289,828 | 12/1966 | Dick et al. | 206/597 |
| 3,338,405 | 8/1967 | Hadenka et al. . | |
| 3,357,553 | 12/1967 | Dick et al. | 206/597 |
| 3,403,780 | 10/1968 | Binkley et al. | 206/597 |
| 3,523,694 | 8/1970 | Oliver | 280/33.99 |
| 3,659,707 | 5/1972 | Nilsson . | |
| 3,768,639 | 10/1973 | Dogliotti | 206/45.19 |
| 3,799,382 | 3/1974 | Munroe | 206/558 X |
| 3,825,113 | 7/1974 | Kramer et al. | 206/497 |
| 3,891,086 | 6/1975 | Isaacs | 206/497 X |
| 4,165,806 | 8/1979 | Cayton | 206/386 |
| 4,201,138 | 5/1980 | Cox | 206/597 X |
| 4,287,991 | 9/1981 | Donnelly | 206/597 |
| 4,311,239 | 1/1982 | Schlicker | 206/597 |
| 4,567,981 | 2/1986 | Headon | 206/45.14 |
| 4,690,281 | 9/1987 | Berthet | 206/597 |
| 4,793,490 | 12/1988 | Evert | 206/497 |

FOREIGN PATENT DOCUMENTS

| | | | |
|---|---|---|---|
| 2650288 | 5/1978 | Fed. Rep. of Germany | 206/386 |
| 3100815 | 11/1982 | Fed. Rep. of Germany | 206/497 |
| 2391115 | 1/1979 | France | 206/600 |

*Primary Examiner*—Bryon P. Gehman

[57] ABSTRACT

A transport and merchandising assembly consists of a multiplicity of package modules stacked upon pallets, several of which are in turn disposed upon the support surface of a skid. The stacks are independently wrapped to provide separate subassemblies, which are in turn secured to the skid by a secondary wrapping. The carton of each package module consists of a tray-like base component and a sidewall component, the latter being readily removable to expose the product units, which are stably supported by a stand inserted within the recess of the base component.

9 Claims, 5 Drawing Sheets

DISPLAY PACKAGE MODULE FOR PROMOTIONAL DISPLAY USE

BACKGROUND OF THE INVENTION

It is of considerable importance to manufacturers of consumer goods that their products be shipped to the retail outlet and presented to customers in a most economical, efficient, convenient and effective manner. The goods are typically transported from the source in bulk, as pallet loads of stacked boxes, each of which may contain a substantial number of units of the product. Before the product can be presented for purchase, therefore, it will normally be necessary to unload the pallet and remove the product from its container, often with the added step of placing the individual units on a stand or display panel. These procedures are time-consuming, inconvenient, inefficient and expensive.

The idea of providing a single pallet, for supporting a number of stacks of product containers, is old in the art. Similarly known are the concepts of providing layers of product in a stack, of providing a point of purchase display column on a pallet, and of using shrink wrap or the like to secure stacks of goods in position upon a pallet. Illustrative of such prior art are the following United States patents:

Van Moss et al U.S. Pat. No. 3,049,265 provides a series of stacked containers which can be secured together, each stack being capable of receiving the tines of a forklift truck.

Strouth U.S. Pat. No. 3,137,388 and Hadenka et al U.S. Pat. No. 3,338,405 show multiple column stacks on a pallet.

Oliver U.S. Pat. No. 3,523,694 discloses a merchandising rack having a dolly at the base, which is disassembled as the uppermost layer is utilized.

Nilsson et al U.S. Pat. No. 3,659,707 shows a pallet for supporting several stacks; slots in the pallet allow the individual stacks to be separated, by cuts made between the "rims" of partitions that are used to separate the elements of the stacks.

Cayton U.S. Pat. No. 4,165,806 discloses a pallet supporting a plurality of stacks, intermediate horizontal plates being provided to transfer the weight of the load to the pallet rather than to underlying cartons.

Donnelly U.S. Pat. No. 4,287,991 provides a pallet assembly with a series of stacks, the pallet being severable to allow removal of one stack at a time; corner braces and transverse and vertical tension bands are used to hold the individual stacks together on the pallet, and to allow them to be removed as individual units.

Schlicker U.S. Pat. No. 4,311,239 teaches the use of a flexible wrap in place of straps to secure stacks to a pallet.

Headon U.S. Pat. No. 4,567,981 shows a point-of-purchase display system, in which elements of a stack are held together on a pallet with shrink wrap material to enable transport and placement.

It is an object of the present invention to provide a novel integrated assembly of package modules, which can be used to transport goods and to thereafter present them to customers in a manner that is economical, efficient, convenient and effective.

It is a more specific object to provide such an assembly in which independent subassemblies comprised of separate stacks of package modules are integrated, and can be removed for independent, free-standing display.

It is another object of the invention to provide a package module, including a box or carton having a component that can readily be removed for display of the individual package units contained therewithin, which module is adapted for use either in the integrated assembly of the invention, or as an independent unit.

Additional objects are to provide such a module in which the product units are securely supported for transport and display, and in which the components are few in number and of uncomplicated construction, thereby rendering the module relatively facile and inexpensive to produce.

A further object of the invention is to provide a novel method for the assembly and transport of package modules and product units, which affords unique shipping integrity coupled with merchandising flexibility.

SUMMARY OF THE INVENTION

It has now been found that certain of the foregoing and related objects of the invention are readily attained by the provision of an integrated assembly of package modules. The assembly comprises a skid having an upper, normally horizontal support surface, a plurality of pallets arranged in side-by-side relationship upon the support surface, a multiplicity of package modules arranged as a plurality of stacks upon the pallets, first means for separately securing each of the stacks of modules to the associated pallet to provide a plurality of independent subassemblies, and second means for securing all of the subassemblies to the skid to provide the integrated assembly.

Normally, the pallets and modules of the assembly lie substantially within the lateral bounds of the skid support surface, as defined by an upward projection from about the periphery thereof, and the pallets will have support surfaces that are dimensioned and configured to cumulatively occupy substantially the same area as the skid support surface when contiguously arranged. The securing means employed will advantageously comprise overwraps of plastic film, and the assembly may additionally include relatively rigid protective members overlying the subassemblies and extending longitudinally therealong at spaced peripheral locations thereabout. Generally, the skid and pallets will be rectangular, and there will be four substantially identical pallets.

The assembly may additionally include decorative skirt means disposed adjacent the lower end of each of the stacks of modules, such means including a covering element movable between an elevated position away from the associated pallet, and a lowered position overlying and obscuring the peripheral surface of the pallet. Such skirt means will preferably be of sufficient width to extend over both the peripheral pallet surface and also the subjacent peripheral surface of the skid, the covering element being longitudinally foldable to permit it to selectively obscure either both of the peripheral surfaces, or the pallet surface only.

Other objects are attained by the provision of a display package module comprising a box, a product stand, and a multiplicity of product units. The box will include a base component and a sidewall component, the latter extending upwardly from about the periphery of the base component to define an internal space, and being readily removable from it. The product stand will be seated within the box and supported by the base component, and it will individually engage and support the product units to extend upwardly beyond the base component within the space defined. Removal of the sidewall component will expose the array of product units for display upon the base component.

The base component of the box may comprise, more specifically, a panel element and a flange element extending upwardly from about its periphery. The sidewall component may comprise a continuous, open-ended shell conforming in cross section to the panel of the base component, to seat within the recess defined by, and in close proximity to, the flange element. The product stand will advantageously be in the form of a one-piece insert, dimensioned and configured to seat upon the panel and within the recess of the base component, and in close peripheral proximity to its flange element; it will define a multiplicity of upwardly-opening channels dimensioned and configured to receive, and to securely interengage, the product units. In most instances the box components will be of folded paperboard construction and the insert will be of molded plastic construction; the product units may be packages having thin, relatively rigid edge portions engaged within the channels of the stand to dispose them in a generally upright orientation within the box. A cover component may be seated upon the upper end of the sidewall component, to enclose the internal space of the box, and the base and cover components will advantageously be of substantially identical construction. An advertising card may be assembled with the cover, and may be adapted for support by the base component (with or without the cover) to extend upwardly from along one edge thereof behind the array of package units.

Additional objects are attained by the provision of a method for the assembly and bulk transport of a multiplicity of package modules, involving the provision of a skid, a plurality of pallets, and a multiplicity of package modules, each as herein described. In the method, a plurality of the modules are stacked upon each of the pallets, and first securing means is applied separately to each of the stacks to secure the modules to the associated pallet and to thereby provide a plurality of independent subassemblies. The pallets are disposed upon the skid support surface, within its lateral bounds, and second securing means is applied to secure the subassemblies to the skid, and to thereby provide the integrated assembly.

The method will normally include the additional steps of transporting the assembly to a display location, and thereafter removing the "second" and then the "first" securing means to provide access to the modules of at least one of the subassemblies. It may also include the steps of removing the "one" subassembly from the skid prior to effecting the first securing means-removal step, and of separating the sidewall component of the uppermost module box of at least one subassembly stack, to expose the product units therewithin for display. The method may involve the further step of displacing the covering element of decorative skirt means to a position along a side surface of the underlying pallet after the "first" securing means is removed.

DETAILED DESCRIPTION OF THE ILLUSTRATED EMBODIMENTS

Figure 1:
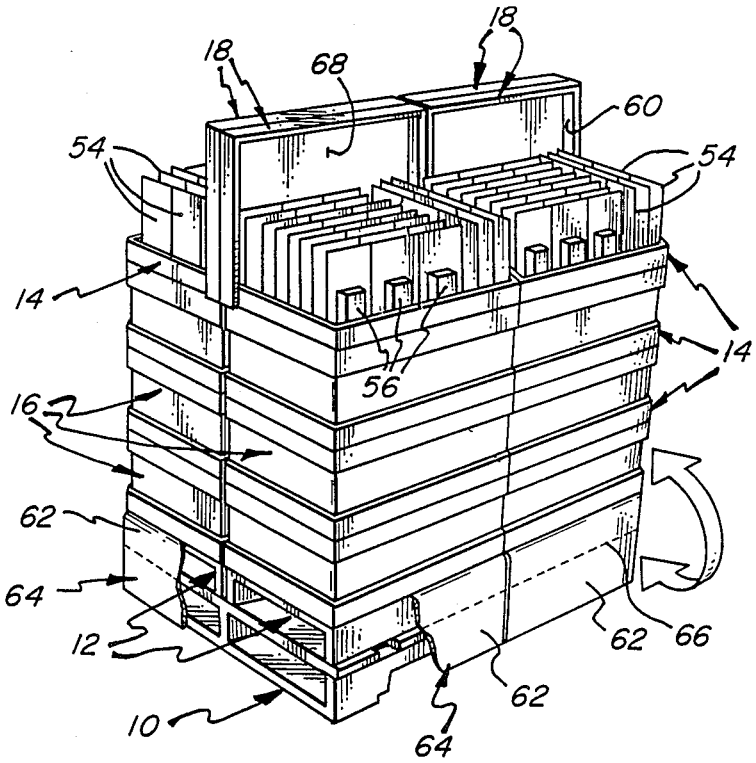
FIG. 1 is a perspective view showing an integrated assembly of package modules embodying the present invention, with the sidewall component of the uppermost box in each stack of modules removed to expose the individual product packages, and with portions of the lowered flaps providing the decorative skirt broken away to expose the underlying pallets and skid.
Figure 2:
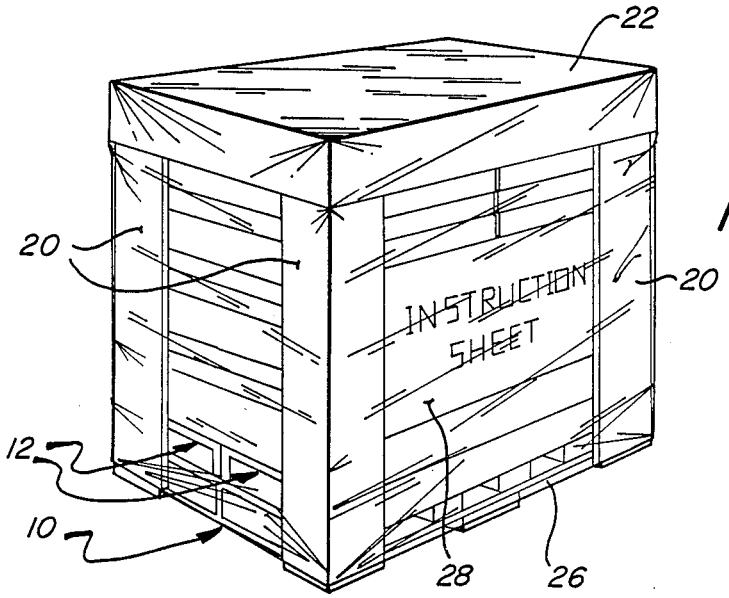
FIG. 2 is a view similar to FIG. 1, showing the integrated assembly intact and in condition for shipment.
Figure 3:
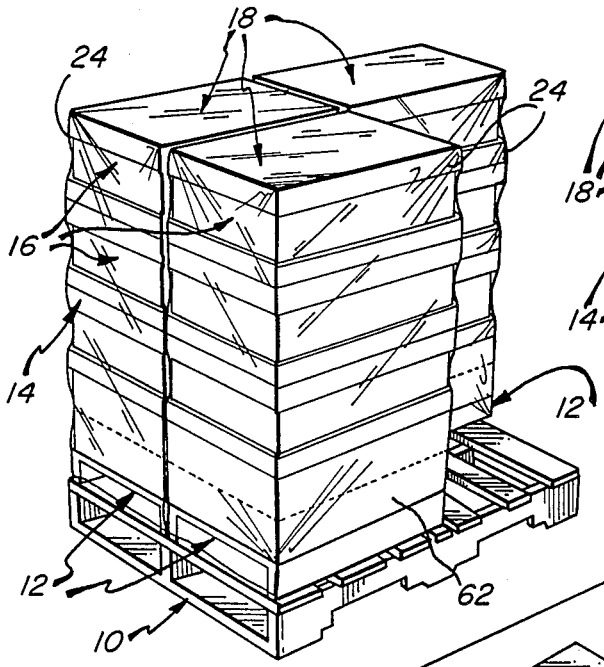
FIG. 3 is an exploded perspective view showing the assembly of FIG. 2 from which the outer overwrap and the protective cap and corner post components have been removed, and showing one subassembly of stacked package modules on a pallet withdrawn from the skid and from the remaining subassemblies.
Figure 3:
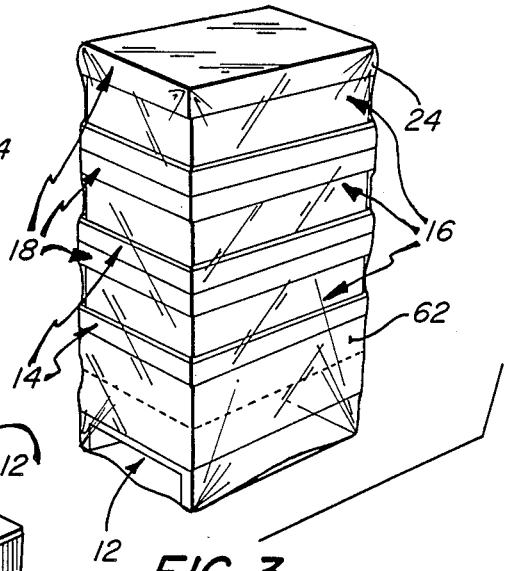

Turning now in detail to the appended drawings, the integrated promotional or merchandising assembly of the invention is shown intact in FIG. 2, and in different stages of disassembly in FIGS. 1, 3, 5 and 6. The assembly consists of an underlying skid, or primary pallet, generally designated by the numeral 10, which is of rectangular configuration and has a planar upper surface, which will be horizontally disposed in normal use. Four rectangular, substantially identical secondary pallets, each generally designated by the numeral 12, are provided; it will be noted that they are dimensioned and configured to occupy substantially the same area as the skid 10, when assembled in contiguous side-by-side relationship thereupon and as considered from an overlying, or planar, perspective.

Each pallet 12 supports on its upper surface a stack of four package modules, each including a box or carton comprised of base, sidewall and cover components, which are generally designed respectively by the numerals 14, 16 and 18 and will normally be made of a corrugated or like form of paperboard. Longitudinally folded, right angle post components 20 extend vertically at each corner of the assembly (only three of which are visible however in FIG. 2), and a cap component 22 is positioned on top of the entire arrangement, cooperating with the corner posts 20 to unify, stabilize and protect the load. Stretch wrap coverings 24 of plastic film are applied individually to each column of package modules stacked on one of the pallets 12, and an overall covering 26 of such material is applied to the subassemblies and the skid 10, thereby integrating the assembly and making it ready for shipment. As will be noted in FIG. 2, an instruction sheet 28, explaining the procedures for separating the stacks and for setting up the product displays, may be enclosed under the outer covering 26 for easy access.

Figure 8:
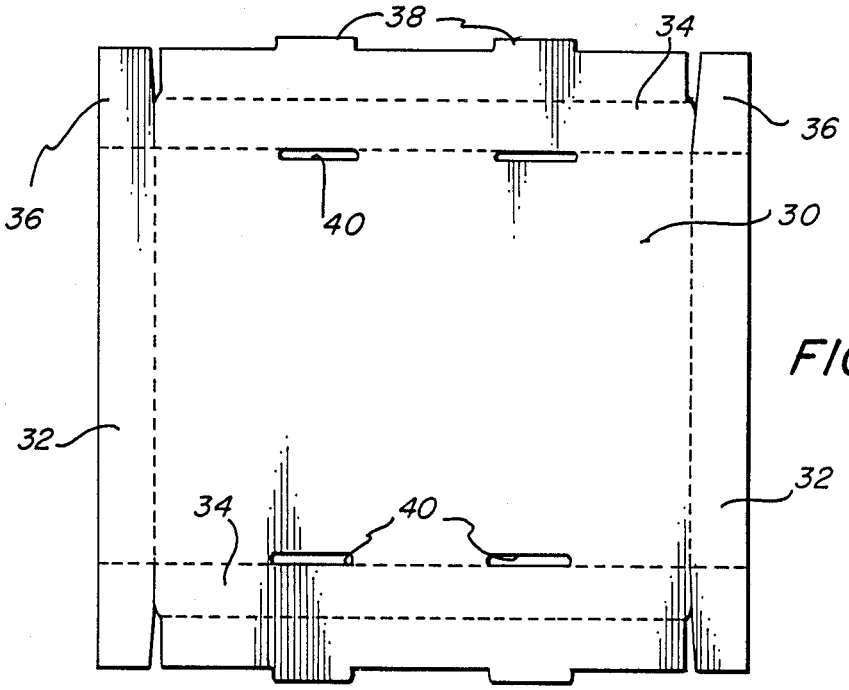
FIG. 8 is a plan view showing a cardboard blank configured to provide, when folded to an erected condition, the base and cover components of the module.
Figure 9:
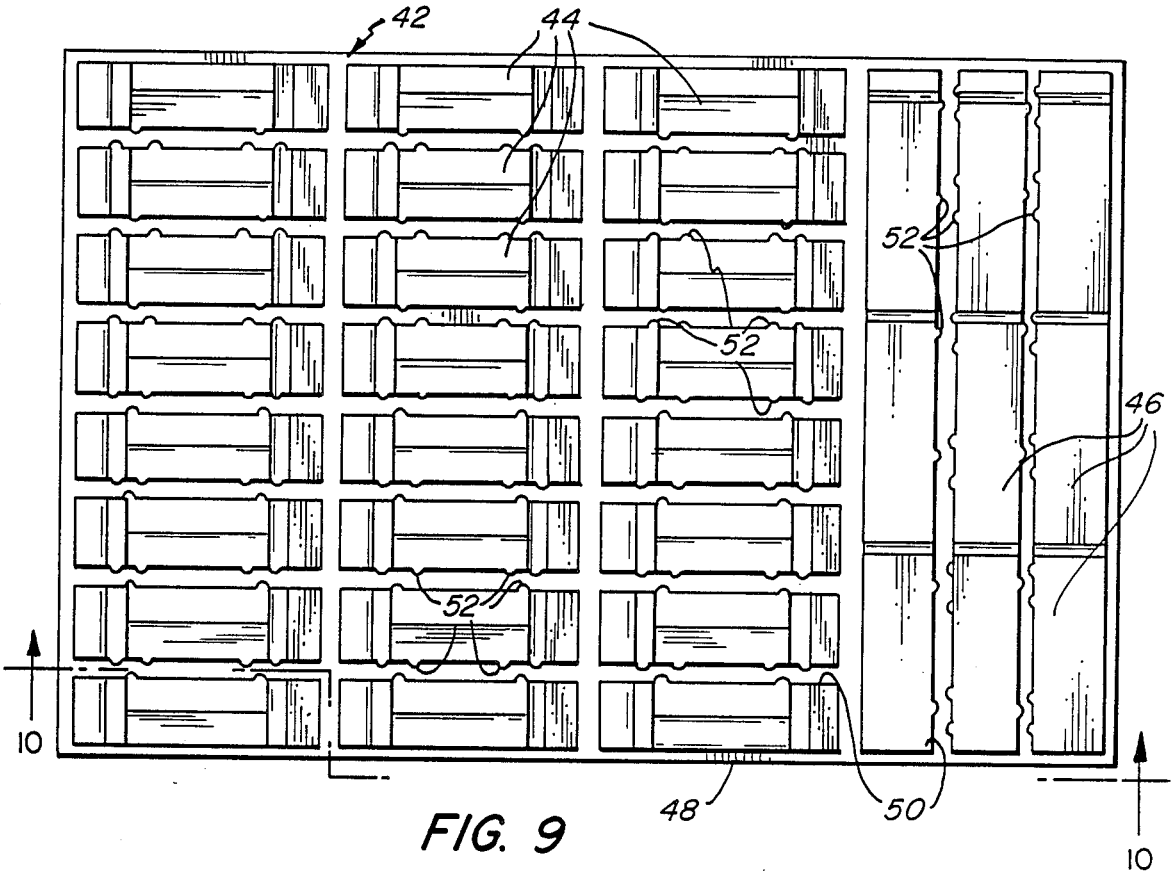
FIG. 9 is a plan view of the product-holding stand of the package module.
Figure 10:
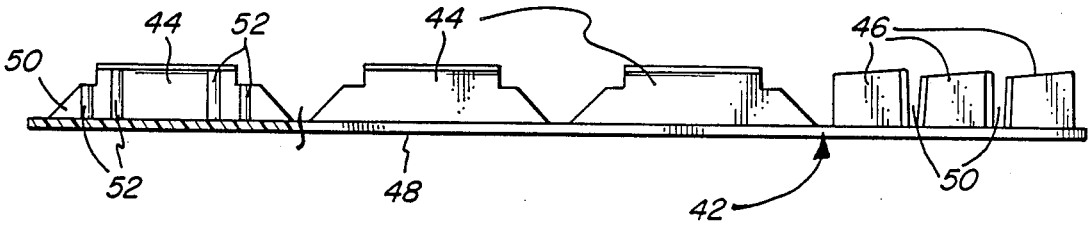
FIG. 10 is a partially elevational and partially sectional view of the stand, taken along line 10—10 of FIG. 9.

Turning now in greater detail to FIGS. 4 and 7–10, it can be seen that the base and cover components 14, 18 of the package module are of the same, tray-like construction, both being erected from the blank illustrated in FIG. 8. The blank consists, more particularly, of a rectangular panel 30 having end and side flaps 32, 34, respectively, hingedly connected as by fold lines (unnumbered). The flaps are folded to positions perpendicular to the panel 30, and the end tabs 36 are folded inwardly; the tabs are sandwiched between the two sections of the flaps 34, when the latter are folded to a face-to-face condition, and they are fixed in place by inserting the locking tabs 38 into the slots 40.

The product stand insert, generally designated by the numeral 42, is of one-piece molded plastic construction, and may readily be made by conventional vacuum thermoforming operations. The stand comprises two different configurations of upstanding formations 44, 46, which are surrounded by a narrow peripheral base flange 48. The formations are elongated, and are separated by relatively deep slots or channels 50; small vertical rib elements 52 project into the channels from the opposing surfaces of adjacent formations 44, 46, and they are interposed in laterally offset relationships to produce an enhanced gripping effect upon elements forced between them.

The package units contained within the module cartons consist, in the illustrated embodiment, of blister packs comprised of a backing board or card 54 and a product-containment blister portion 56. They are supported in upright positions on the stand 42 by engagement of one edge of the backing board 54 within a channel 50 formed between an adjacent pair of the formations 44 or 46; some of the product units are disposed at right angles to the others for optimal presentation.

Figure 4:
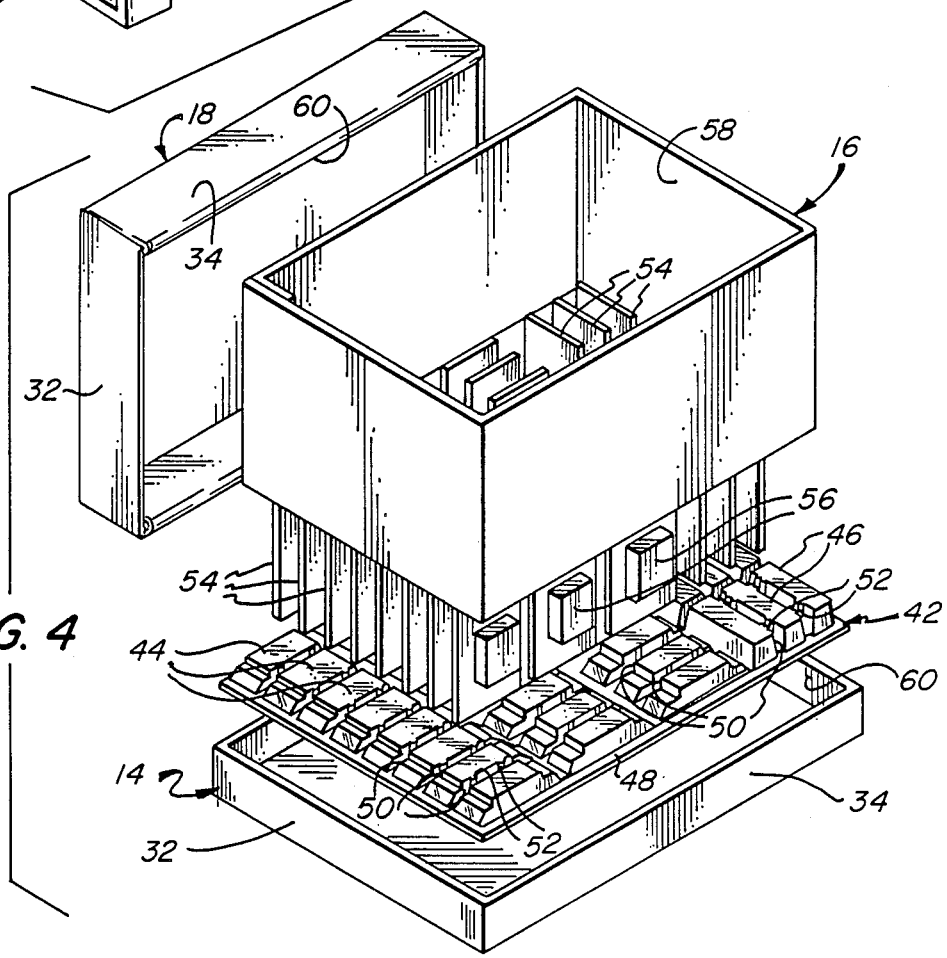
FIG. 4 is an exploded perspective view of a package module embodying the present invention.

As can best be seen in FIG. 4, the shell 16 providing the sidewall of the package module box comprises a strip of paperboard folded into a rectangular, open-ended configuration. The shell is dimensioned and configured to fit within the recess 60 defined by the panel 30 and the peripheral flange (formed when the flaps 32, 34 are folded to erected condition) of the base component 14, to create a container in cooperation therewith, which is closed at one end and defines an interior space 58. Being of the same construction, it will be appreciated that the cover component 18 is adapted to fit on top of the shell 16, and to close the opposite end thereof.

The package module is created by initially inserting the edge portions of the product cards 54 into the engagement channels 50 of the stand 42, to arrange them as a free-standing, disengageably supported array, and the stand is then placed into the recess 60 of the base component 14. The shell 16 is positioned within the recess on top of the base flange 48, surrounding the array of product packages, and finally, the cover component 18 is put into place on the shell.

After stacking the modules one atop the other on one of the pallets 12, the inner shrink wrap covering films 24 are applied to each. Four of the resultant subassemblies are then placed, side-by-side, on the support surface of the skid 10, the protective elements 20, 22 are positioned, the instruction sheet 28 is inserted, and the outer film wrap 22 is finally applied.

Figure 5:
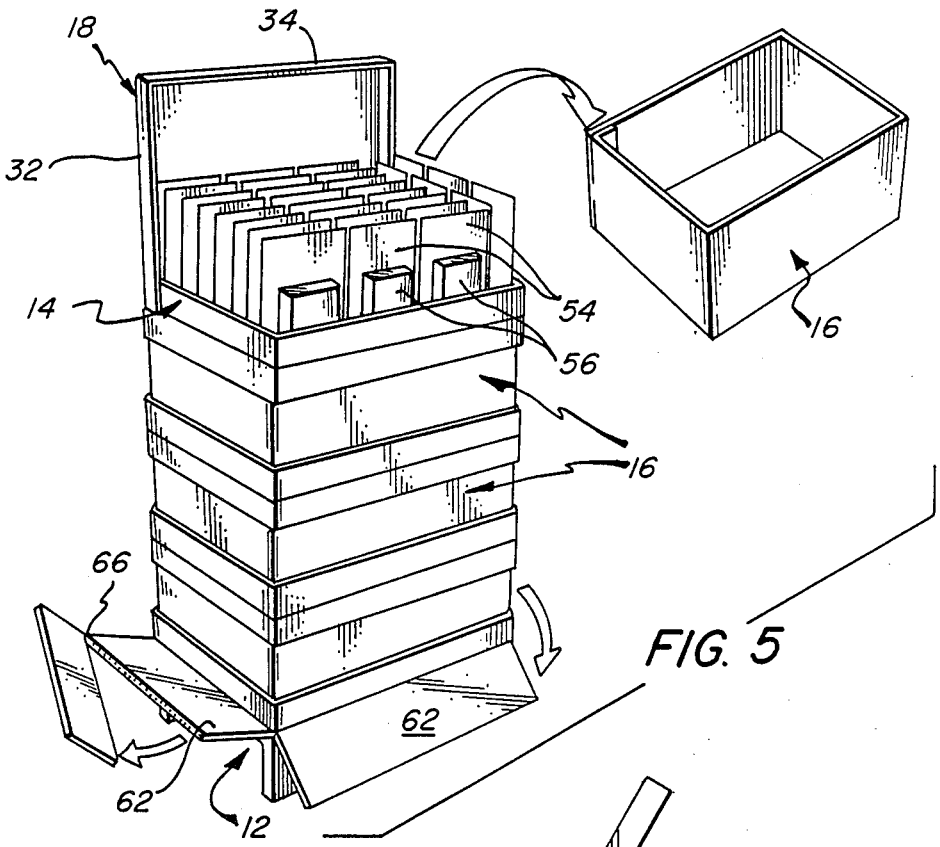
FIG. 5 is an exploded perspective view showing the stack of modules of one of the subassemblies with its overwrap and the sidewall component of the top carton removed, also showing the decorative flaps being lowered with one being severed to eliminate its bottom section.
Figure 6:
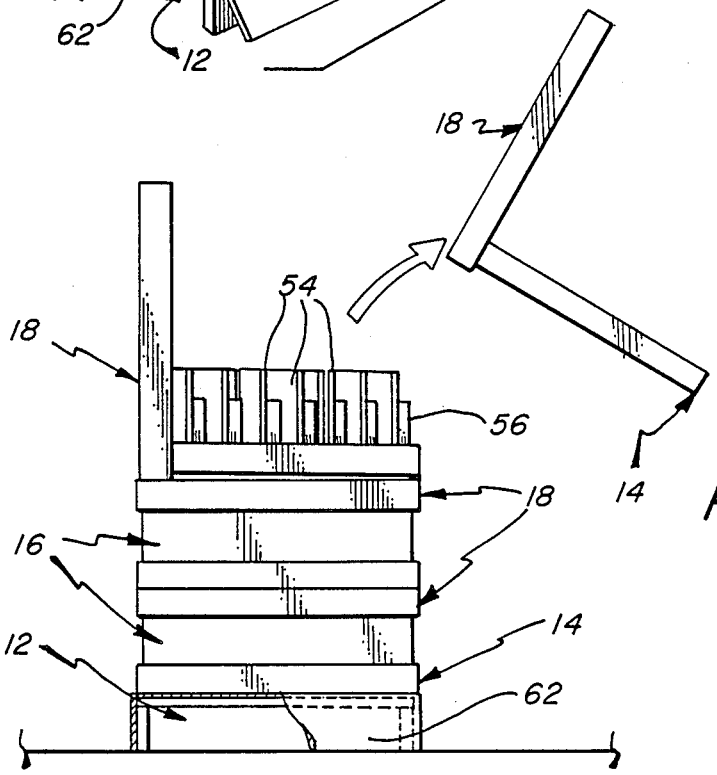
FIG. 6 is an exploded elevational view of the stack of FIG. 5, showing the emptied base and cover components of the top carton, and the sidewall shell of the underlying module, removed.
Figure 7:
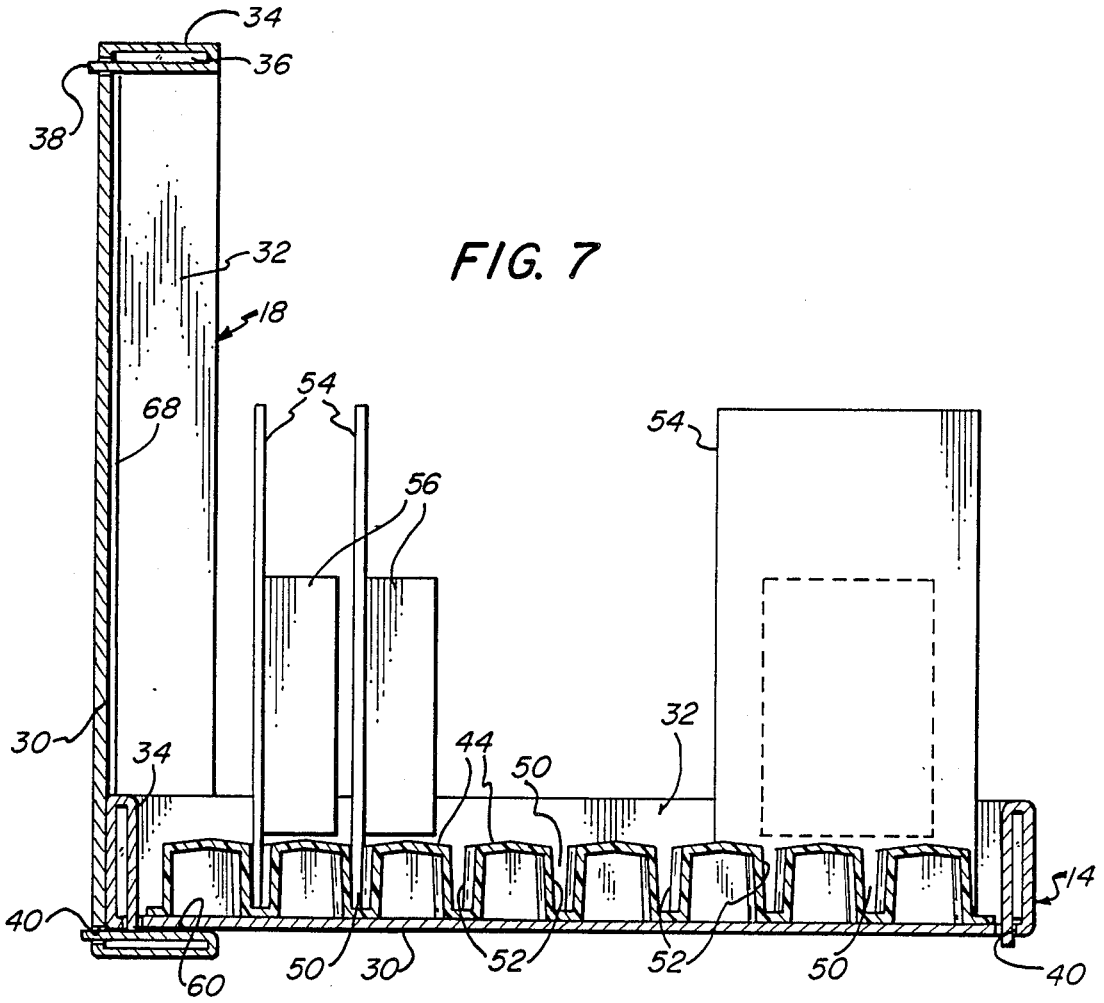
FIG. 7 is a vertical sectional view of the module of FIG. 4 drawn to an enlarged scale, with the sidewall component removed and with the cover component assembled with the base component, in a display mode.

When the assembly reaches its point of sale destination, the outer wrap and protective elements are of course removed. All four of the independent subassemblies may then be left on the skid, to provide a single merchandising system, or one or more of them may be removed to a different place. If the entire load is to be left at one location, the covering elements 62 of decorative skirt members 64 are folded down to obscure from view the lateral surfaces of the pallets 12 and the skid 10; this is best seen in FIG. 1. Although not fully illustrated, it will be appreciated that the skirt member 64 associated with each subassembly consists of a rectangular central panel (not visible in any Figure) having four rectangular flaps extending outwardly from its periphery. The flaps constitute the covering elements 62; during shipment, they are disposed along the sides of the directly overlying package module, and are held in place by the inner securing wrap 24. The flaps may be transversely creased at 66 so that, when a stack of modules is separated from the assembly and used independently, the lower half of the covering element can be folded inwardly and upwardly to conform to the height of the pallet alone; alternatively, the flaps may be perforated to permit the lower half to be severed and removed, as indicated in FIG. 5.

As seen in FIGS. 1 and 5–7, removal or the cover and sidewall components 16, 18 from the box will display the array of product packages conveniently and attractively. The cover component can be assembled with the base component in a perpendicular orientation, as shown, rendering the cover component effective as a prop for supporting advertising matter, which can be a sign in the form of a separate panel 68 that is normally stored within the cover component recess 60, and can be used with or without the cover component. It will be appreciated that the package modules may also be employed as independent merchandising units, such as for presentation of the product from a counter top display, apart from either the individual stack or the assembly of stacks in which it is transported.

Suitable materials of construction for the several components of the assembly will be evident to those skilled in the art, and the disclosure of specific materials herein is not to be construed as limiting. For example, although corrugated paperboard has been suggested for fabrication of the box and protective members, plastic components may be preferred in certain instances. Metal, fibrous or paper wrapping may be substituted for the plastic film overwraps described, the product stand may obviously be of other than molded plastic fabrication, and the skid and pallets will normally be made of wood. Although four pallets on a skid have been illustrated, obviously other arrangements can be used.

Thus, it can be seen that the present invention provides a novel integrated assembly of package modules which can be used to transport goods and to thereafter present them to customers in a manner that is economical, efficient, convenient and effective, and from which independent subassemblies comprised of separate stacks of package modules can be removed for independent, free-standing display. The invention also provides a package module, including a carton having a component that can readily be removed for display of the contained individual package units. The module is particularly adapted for use in the integrated assembly of the invention, the product units are securely supported for transport and display thereby, and it is comprised of components that are few in number and of uncomplicated construction, thereby rendering the module relatively facile and inexpensive to produce. In addition, the invention provides a novel method for the assembly and transport of package modules and contained product units, which affords unique shipping integrity coupled with merchandising flexibility.

Having thus described the invention, what is claimed is:

1. A display package module comprising a box; a product stand within said box; and a multiplicity of product units within said box on said product stand; said box including a base component and a sidewall component removably assembled therewith and extending upwardly about the periphery of said base component to define an internal cavity within which said product stand and product units are disposed, said base component comprising a base panel element with a flange element extending upwardly about the periphery thereof, said sidewall component comprising a unitary shell substantially conforming in cross section to said base panel element and seated within the recess defined by said flange element in close proximity thereto; said product stand being unitary and seated upon and supported by said base panel element of said base component, said product stand being substantially disposed within said base panel element so as to be substantially enclosed thereby, said product stand providing a multiplicity of upwardly extending recesses, and said product units being individually engaged and stably supported in said recesses of said stand to extend upwardly beyond said base component within said cavity, whereby removal of said sidewall component will expose said product units for display upon said base component, said product units extending above said flange element and said product stand for display thereon upon removal of said sidewall component.

2. The module of claim 1 wherein said sidewall component comprises a continuous, open-ended shell.

3. The module of claim 1, wherein said product stand is a one-piece insert dimensioned and configured to seat within said recess upon said base panel element and in close peripheral proximity to said flange element, said insert defining a multiplicity of upwardly-opening channels dimensioned and configured to receive said product units in secure interengagement therewith.

4. The module of claim 3 wherein said box components are of folded paperboard construction, and wherein said insert is of molded plastic construction.

5. The module of claim 3 wherein said product units are packages having thin, relatively rigid edge portions engaged within said insert channels to dispose said units in a generally upright orientation within said box.

6. The module of claim 2 wherein said box additionally includes a cover component seated upon the upper end of said sidewall component and enclosing said internal space.

7. The module of claim 6 wherein said base and cover components are of substantially identical, tray-like construction.

8. The module of claim 6 additionally including an advertising card normally assembled with said cover, said card being adapted to be supported in a position extending upwardly from along one edge of said base component behind said package units.

9. An integrated assembly of package modules, comprising: a skid having an upper, normally horizontal support surface, a plurality of rectangular pallets arranged in side-by-side relationship upon said support surface, a multiplicity of package modules arranged as a plurality of stacks upon said pallets, each of said stacks comprising a multiplicity of vertically disposed package modules, horizontally adjacent package modules being elements of different stacks; first means extending vertically along all four sides of the modules and engaged with the modules of a stack and with all four side of its associated pallet for separately securing each of said stacks of modules to the associated one of said pallets to provide a plurality of independent subassemblies separately removable from said skid with said first means substantially intact; and second means engaged with and securing all of said subassembly to said skid to provide said integrated assembly, said second means being disengagable from said subassemblies without injury to said first means, said subassemblies of said pallets and modules lying substantially within the peripheral of said skid support surface; said pallets having support surface which are dimensioned and configured to cumulatively occupy substantially the same area as said skid support surface; each of said package modules comprising: a box, a product stand within said box, and a multiplicity of product units within said box on said product stand, said box including a base component and a sidewall component removably assembled therewith and extending upwardly about the periphery of said product stand and product units are disposed, said base component comprising a base panel element with a flange element extending upwardly about the periphery thereof, said sidewall component comprising a unitary shell substantially conforming in cross section to said base panel element and seated within the recess defined by said flange element in close proximity thereto, said product stand being unitary and seated upon and supported by said base panel element of said base component, said product stand being substantially disposed within said base panel element so as to be substantially enclose thereby, said product stand providing a multiplicity of upwardly extending recesses and said product units being individually engaged and stably supported in said recesses of said stand to extend upwardly beyond said base component within said cavity, whereby removal of said sidewall component will expose said product units for display upon said base component, said product units extending above said flange element and said product stand for display thereof upon removal of said sidewall component.

* * * * *

UNITED STATES PATENT AND TRADEMARK OFFICE

CERTIFICATE OF CORRECTION

PATENT NO. : 4,877,137

DATED : October 31, 1989

INVENTOR(S) : James A. Govang and Mark E. Goldstein

It is certified that error appears in the above-identified patent and that said Letters Patent is hereby corrected as shown below:

Column 8, line 29, "peripheral" should be --periphery--.

Column 8, line 38, after "said" insert --base component to define an internal cavity within which said--.

Column 8, line 49, "enclose" should be --enclosed--.

Signed and Sealed this

Thirtieth Day of October, 1990

*Attest:*

HARRY F. MANBECK, JR.

*Attesting Officer*

*Commissioner of Patents and Trademarks*